US008042481B2

(12) United States Patent
Iwakami et al.

(10) Patent No.: US 8,042,481 B2
(45) Date of Patent: Oct. 25, 2011

(54) STEERING UNIT FOR SMALL WATERCRAFT

(75) Inventors: Hiroshi Iwakami, Saitama (JP); Akira Nagakubo, Saitama (JP); Kyohei Hosoya, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 339 days.

(21) Appl. No.: 12/393,611

(22) Filed: Feb. 26, 2009

(65) Prior Publication Data

US 2009/0229504 A1 Sep. 17, 2009

(30) Foreign Application Priority Data

Mar. 17, 2008 (JP) ..... 2008-068028

(51) Int. Cl.
*B63H 25/04* (2006.01)

(52) U.S. Cl. ..... 114/144 R; 114/55.52

(58) Field of Classification Search ..... 114/144 R, 114/55.52; 440/83; 384/125, 235, 275
See application file for complete search history.

(56) References Cited

U.S. PATENT DOCUMENTS

| | | | | |
|---|---|---|---|---|
| 4,905,487 | A * | 3/1990 | Morikawa et al. | 70/186 |
| 5,033,871 | A * | 7/1991 | Ide | 384/98 |
| 5,357,868 | A * | 10/1994 | Maas | 105/180 |
| 6,149,526 | A * | 11/2000 | Boersma et al. | 464/89 |
| 6,902,452 | B1 * | 6/2005 | Knight | 440/83 |
| 2005/0260899 | A1 * | 11/2005 | Nakamura et al. | 440/53 |

FOREIGN PATENT DOCUMENTS

JP 2003-137173 A 5/2003

* cited by examiner

*Primary Examiner* — Stephen Avila
(74) *Attorney, Agent, or Firm* — Birch, Stewart, Kolasch & Birch, LLP

(57) ABSTRACT

A steering unit for a small watercraft, which can positively prevent jolting of a steering shaft relative to a bearing section for allowing smooth rotation of the steering shaft, and makes for improving the installing characteristic of the steering shaft and a collar into the bearing section. A steering shaft is rotatably supported with respect to a watercraft body through a cylindrical bearing section in which the steering shaft is inserted. A plurality of ribs are provided around an inner surface of the cylindrical bearing section and extend in an axial direction of the steering shaft. The steering shaft is rotatably supported by the bearing section with a collar, formed from an elastic material, being provided interposedly between the ribs and an outer surface of the steering shaft. The cylindrical bearing section includes at least three or more ribs are provided.

18 Claims, 7 Drawing Sheets

STEERING UNIT FOR SMALL WATERCRAFT

CROSS-REFERENCE TO RELATED APPLICATIONS

The present application claims priority under 35 USC 119 to Japanese Patent Application No. 2008-068028 filed on Mar. 17, 2008 the entire contents of which are hereby incorporated by reference.

FIELD OF THE INVENTION

The present invention relates a steering unit for a small watercraft.

DESCRIPTION OF BACKGROUND ART

A steering unit for a small watercraft is known wherein a steering shaft (41) is rotatably supported with respect to a watercraft body (11) by a cylindrical bearing section (57) in which the steering shaft (41) is inserted. See, for example, JP-A No. 2003-137173.

The small watercraft is often used on the sea, so that the steering shaft (41) and the bearing section (57) are formed of synthetic resin from the viewpoint of anticorrosion.

Moreover, collars (57*a*, 57*b*) are provided interposedly between the steering shaft (41) and the bearing section (57) at an upper and lower portion of the bearing section (57).

Although the JP-A No. 2003-137173 does not describe the material of the collars (57*a*, 57*b*), it is desirable from the viewpoint of anticorrosion that the collars are formed of synthetic resin.

Moreover, the steering shaft (41) and the bearing section (57) are made of synthetic resin and their dimensional precisions are not always high, so that in order to prevent jolting of the steering shaft relative to the bearing, it is desirable that the collars are made from elastic materials such as rubber or the like for absorbs the jolting.

However, if a collar is formed from elastic materials, the following problems occur with respect to the steering unit for the small watercraft.

If the thicknesses of the collars formed from the elastic materials are made thick in order to positively prevent the jolting of the steering shaft relative to the bearing section, the steering shaft becomes a condition in which it is pushed by substantially the entire inner surfaces of the collars, so that rotation of the steering shaft becomes slow. Moreover, the inserting operation for pushing the steering shaft and the collars into the bearing section becomes very difficult.

Conversely, if the thicknesses of the collars are made rather thin in order that the steering shaft can be smoothly rotated and the inserting operation of the steering shaft and the collars into the bearing section can be easily performed, a problem occurs wherein the jolting of the steering shaft relative to the bearing section is easy to occur.

SUMMARY AND OBJECTS OF THE INVENTION

An object of an embodiment of the present invention is to address the above-mentioned problems and provide a steering unit for a small watercraft, which can positively prevent jolting of a steering shaft relative to a bearing section and, at the same time, allows smooth rotation of the steering shaft, and makes it possible to improve installing characteristic of the steering shaft and the collars into the bearing section.

In order to address the above-mentioned problems, according to an embodiment of the present invention, there is provided a steering unit for a small watercraft, which includes a cylindrical bearing section and a steering shaft inserted in the cylindrical bearing section and rotatably supported on a watercraft body by the cylindrical bearing section, wherein the cylindrical bearing section has a plurality of ribs provided around an inner surface thereof and extending in an axial direction of the steering shaft, and the steering shaft is rotatably supported by the bearing section with a collar, formed from an elastic material, being provided interposedly between the ribs and an outer surface of the steering shaft. In one embodiment, at least three or more ribs are provided.

According to the steering unit of the small watercraft of an embodiment of the present invention, the cylindrical bearing section has the plurality of ribs provided around the inner surface thereof and extending in the axial direction of the steering shaft, and the steering shaft is rotatably supported by the bearing section with the collar, formed from the elastic material, being provided interposedly between the ribs and the outer surface of the steering shaft, so that even if dimensional precisions of the steering shaft and the bearing section are not always high, jolting of the steering shaft relative to the bearing section relative can be prevented by the collar formed from the elastic material.

The cylindrical bearing section is provided around the inner surface thereof with a plurality of ribs extending in the axial direction of the steering shaft, and the collar made from the elastic material is provided interposedly between the ribs and the outer surface of the steering shaft, so that even if a thickness of the collar formed from the elastic material is made rather thick in order to positively prevent the jolting of the steering shaft relative to the bearing section, the steering shaft does not become a condition in which it is pushed by substantially entire inner surface of the collar, and becomes a condition in which it is pushed at only regions thereof which positionally correspond to the ribs. In other words, regions of the collar which are located between respective adjacent ribs become a condition in which, exaggeratedly speaking, they are escaped outward in a radial direction, and become a condition in which they do not push the steering shaft.

Therefore, even if the thickness of the collar formed from the elastic material is made rather thick in order to positively prevent the jolting of the steering shaft relative to the bearing section, smooth rotation of the steering shaft is allowed.

Moreover, the regions of the collar which are located between the respective adjacent ribs can be escaped outward in the radial direction, thus making it possible to smoothly perform the inserting operation of the steering shaft and the collar into the bearing section.

As discussed above, according to the present invention, the jolting of the steering shaft relative to the bearing section can be positively prevented and, at the same time, the rotation of the steering shaft is allowed to be smoothly performed. In addition, installing characteristic of the steering shaft and the collar with respect to the bearing section can be improved.

Moreover, at least three or more ribs are provided, thus making it possible to cause the steering shaft to be supported in a stable state by the bearing section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of a steering unit for a small watercraft according to the present invention will be explained hereinafter with reference to the drawings.

Figure 1:
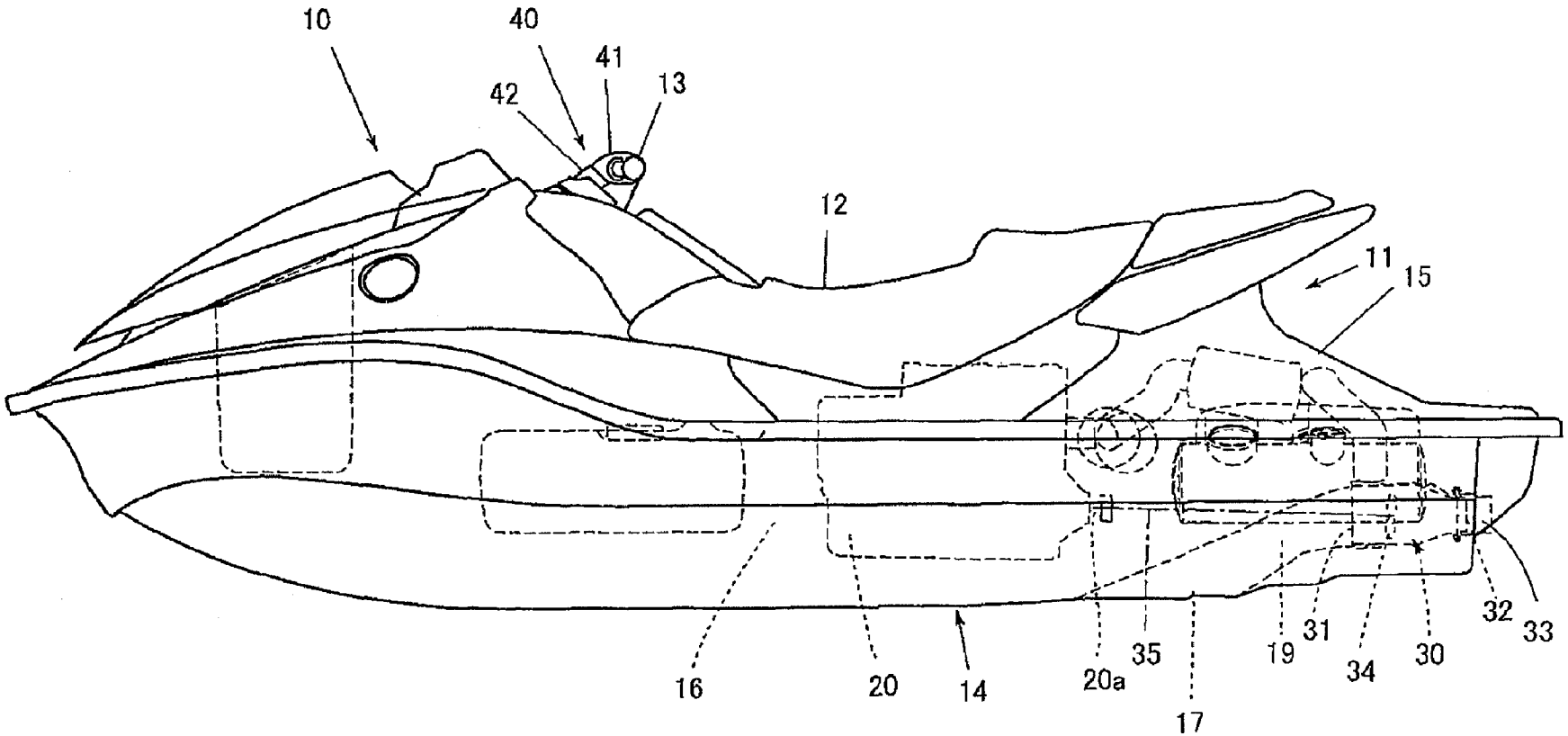
FIG. 1 is a schematic side view illustrating an example of a small watercraft in which an embodiment of a steering unit for a small watercraft according to the present invention is employed.
Figure 2:
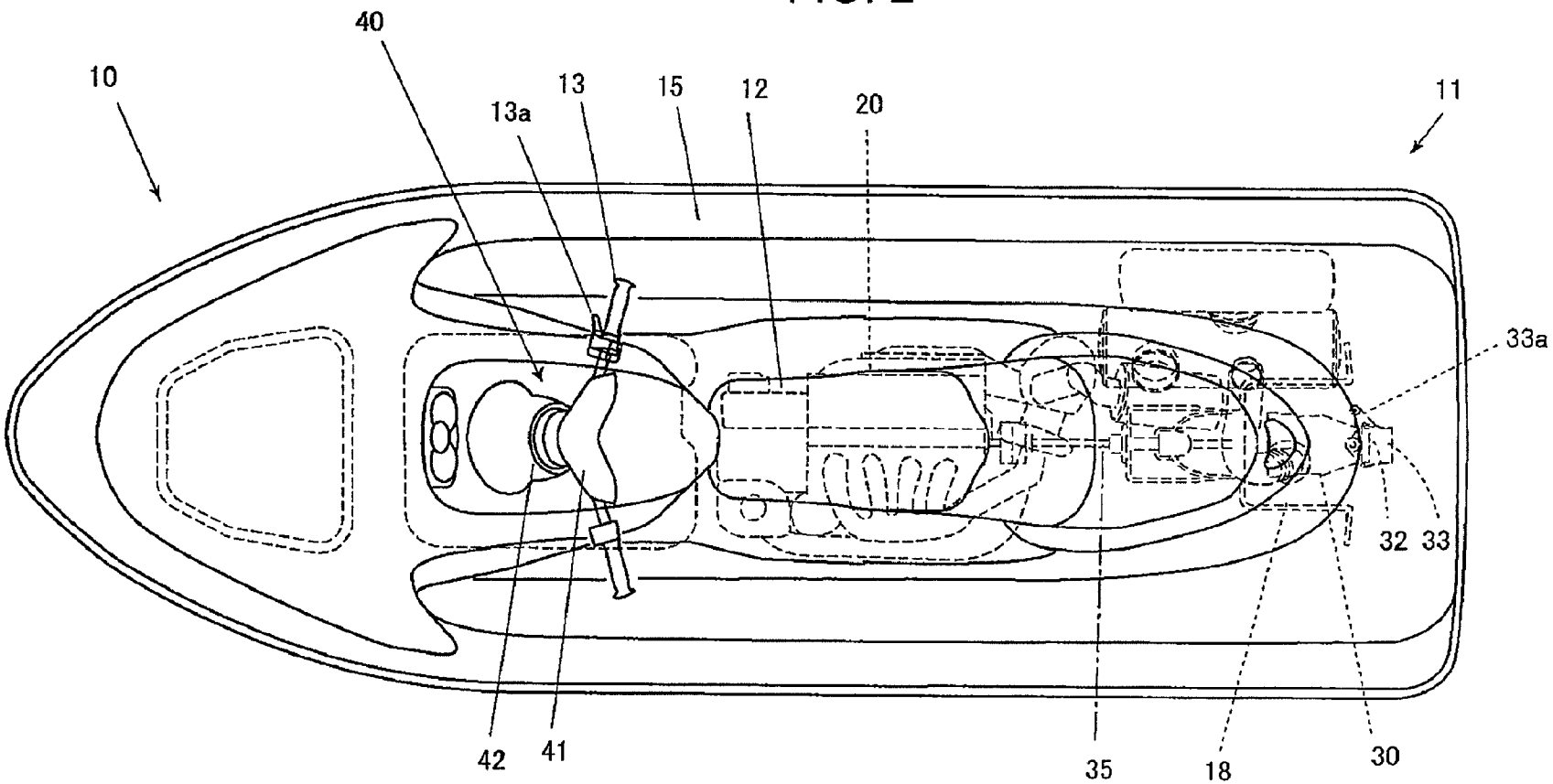
FIG. 2 is a schematic plane view of the small watercraft.

FIG. 1 is a schematic side view showing an example of a small watercraft employing the embodiment of the steering unit for the small watercraft according to the present invention, and FIG. 2 is a schematic plane view of the small watercraft.

As shown in FIGS. 1 and 2, the small watercraft 10 is a saddle-ridge type small watercraft. An occupant sits on a seat 12 on a watercraft body 11, grips a steering handlebar 13 provided with a throttle lever 13*a* for operating the small watercraft.

The watercraft body 11 has a floating body structure in an interior of which a watercraft interior space 16 is formed by joining a hull 14 and a deck 15. In the watercraft interior space 16, an engine 20 is carried on the hull 14, and a jet pump (jet propelling pump) 30 which serves as a propelling means driven by the engine 20 is provided at a rear portion of the hull 14.

At the rear portion of the hull 14, a water path 19 is provided which extends to a pump chamber 18 (refer to FIG. 2) from a water intake port 17 that is opened at a bottom of the watercraft. In the pump chamber 18, the jet pump 30 is provided that communicates with the water path 19.

The jet pump 30 has an opening 31 communicating with the water path 19, a jet stream port 32 and a nozzle 33 which allow water to be jetted rearward of the watercraft body 11. An impeller 34 is provided in a water path which extends from the opening 31 to the jet stream port 32. A shaft 35 of the impeller 34 is connected to an output shaft 20*a* of the engine 20. Therefore, when the impeller 34 is rotation-driven by the engine 20, water introduced from the water intake port 17 flows through the nozzle 33 and is jetted from the jet stream port 32, whereby the watercraft body 11 is propelled. The number of drive revolutions of the engine 20, viz., propulsive power by the jet pump 30 is controlled by pivotal movement operation of the throttle lever 13*a*. The nozzle 33 is connected at a lever 33*a* (FIG. 2) integral therewith to the steering handlebar 13 through an association mechanism including an unshown wire and the like, and is pivotal movement-operated by operation of the steering handlebar 13, whereby a course of the watercraft body 11 can be changed.

In FIGS. 1 and 2, a steering unit 40 is provided together with covers 41 and 42 for the steering unit 40.

As shown in FIGS. 3 to 7, the steering unit 40 is a steering unit, a steering shaft 50 of which is rotatably supported with respect to the watercraft body 11 through a cylindrical bearing section 60 in which the steering shaft 50 is inserted. The cylindrical bearing section 60 has a plurality of ribs 62 which are provided around an inner surface 61 of the cylindrical bearing section 60 and extend in an axial direction of the steering shaft 50 (in an upper/lower direction in FIGS. 4 and 5). The steering unit is configured such that the steering shaft 50 is rotatably supported by the bearing section 60 with a collar 70, formed from an elastic material, being provided interposedly between the ribs 62 and an outer surface 51 of the steering shaft 50.

Regarding the ribs 62, it is desirable that at least three or more ribs are provided and, in the illustrated embodiment, eight ribs 62 are provided so as to be disposed at equal pitches.

The collar 70 is formed of rubber or synthetic resin superior in its flexibility. Preferably, the collar 70 is formed of synthetic resin which is also superior in its smoothness property (for example, POM).

Figure 4:
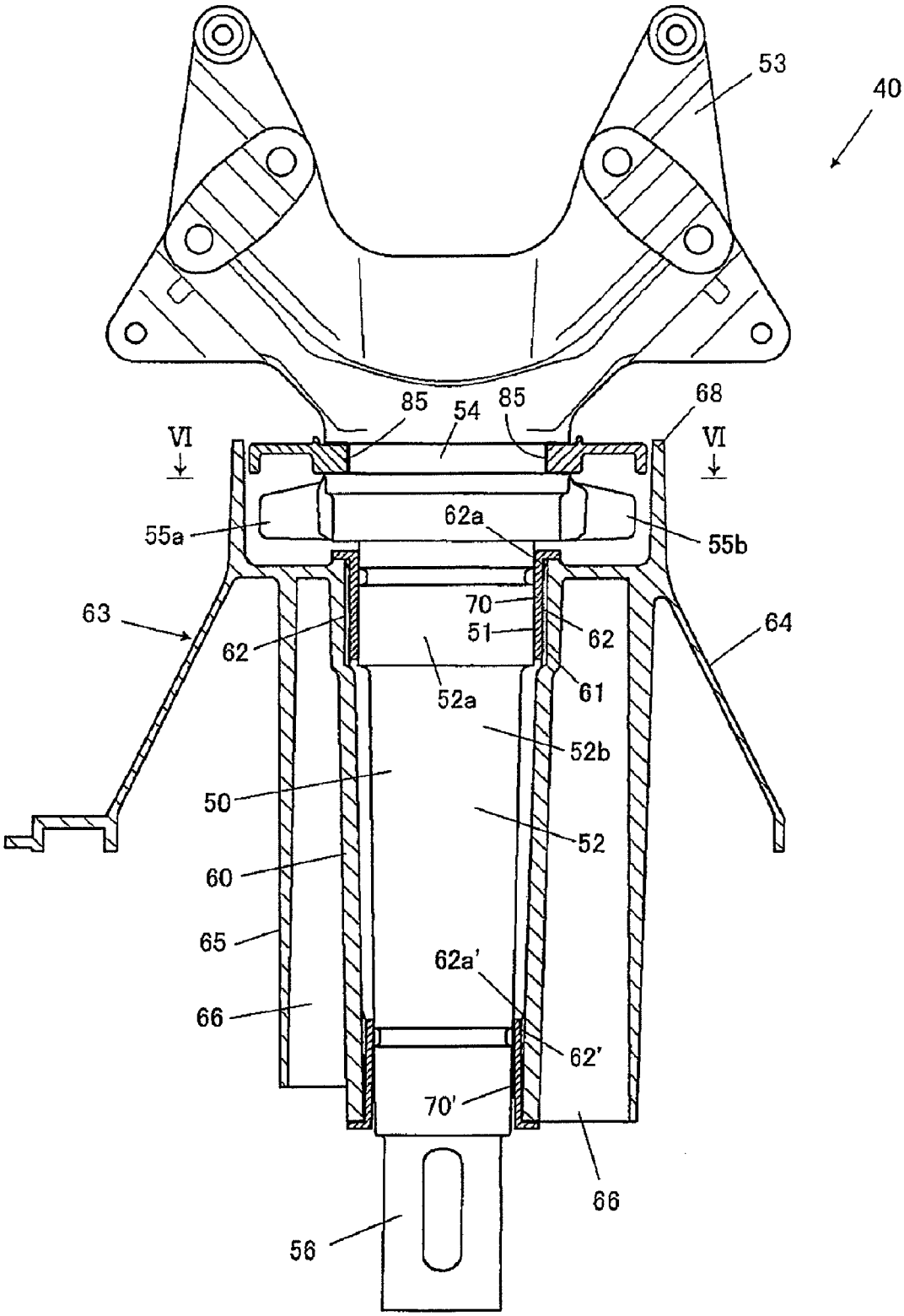
FIG. 4 is a sectional view, taken along IV-IV line in FIG. 3.
Figure 5:
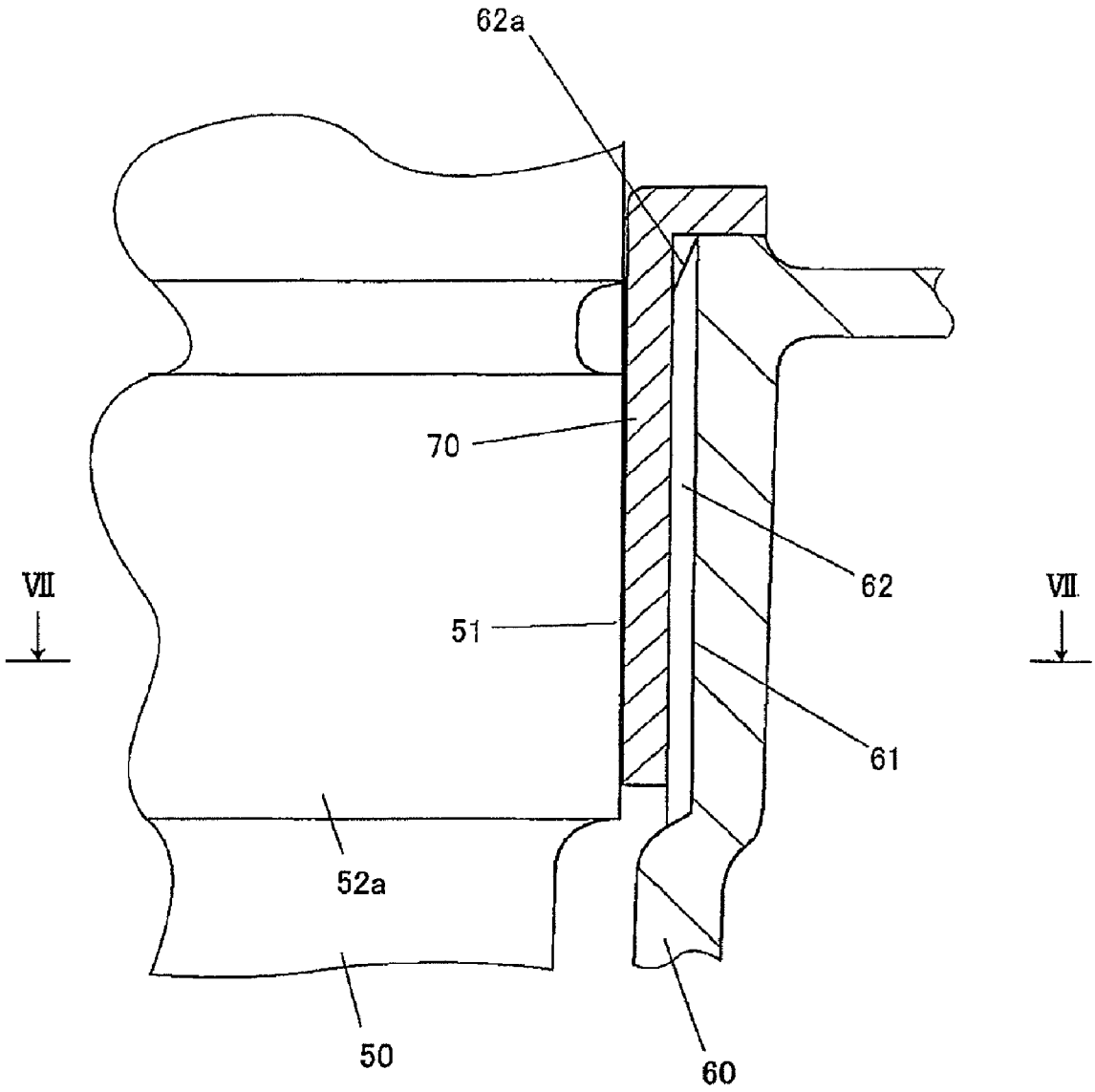
FIG. 5 is an enlarged fragmentary view of FIG. 4.

As shown in FIG. 4, the bearing section 60 is constituted by a steering holder 63.

The steering holder 63 is a one-piece product formed of synthetic resin that includes a support section 64 for causing the bearing section 60 to be supported to the watercraft body 11.

The support section 64 has a cylindrical portion 65 and reinforcing ribs 66 interconnecting the cylindrical portion 65 and the bearing section 60. Regarding the reinforcing ribs 66, eight reinforcing ribs are provided so as to be disposed at equal intervals, when viewed from an unshown plane.

Figure 3:
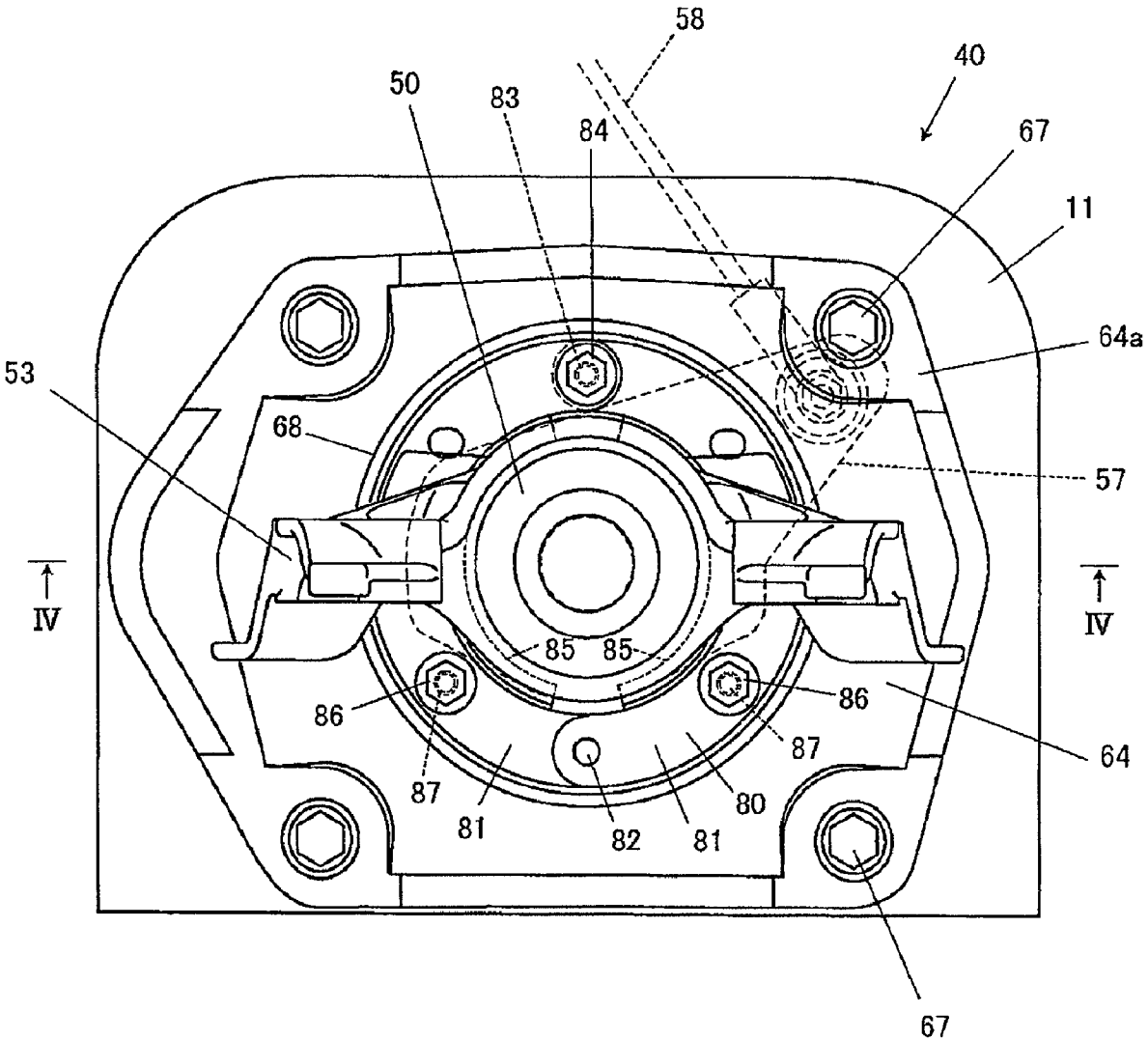
FIG. 3 is a plane view illustrating an essential section of the steering unit.

As shown in FIG. 3, the support section 64 is fixed at a flange portion 64*a* thereof to the watercraft body 11 by bolts 67.

Therefore, the bearing section 60 is strongly mounted with respect to the watercraft body 11 by the support section 64 (and the ribs 66).

As shown in FIGS. 3 and 4, the steering shaft 50 is a one-piece product made of synthetic resin that includes an axial portion 52 and a handlebar mounting portion 53 integrally provided on an upper portion of the axial portion 52. To the handlebar mounting portion 53, the steering handlebar 13 (FIGS. 1 and 2) is mounted.

At a lower portion of the handlebar mounting portion 53, a ring-shaped groove 54 and a pair of protruding portions 55*a*, 55*b* (refer to FIG. 6) for restricting a rotation angle (rotation range) of the steering shaft 50 are provided.

The axial portion 52 has an upper large-diameter portion 52*a* and a tapered portion 52*b* integrally extending downward from the large-diameter portion 52*a*. The inner surface of the bearing section 60 has a shape matching the shape of the axial portion 52 (a shape having a large diameter portion and a tapered portion extending downward from the large diameter portion).

The ribs 62 are provided at regions of the bearing section 60 which are opposed to the large diameter portion 52*a* of the steering shaft 50. The collar 70 is provided interposedly between the ribs 62 and the large diameter portion 52*a*. Upper ends 62*a* of the ribs 62 (refer to FIG. 5) exhibit upward ascending slopes.

The steering shaft 50 is mounted in the bearing section 60 by inserting the steering shaft 50 into the bearing section 60 in a condition in which the collar 70 is mounted around the large diameter 52*a*, or is mounted in the bearing section 60 by causing the collar 70 to be previously mounted in the bearing section 60 and then inserting the steering shaft 50 into the bearing section 60.

When the steering shaft 50 is to be inserted into the bearing section 60, a stopper ring 80 is mounted in the ring-shaped groove 54 of the steering shaft 50.

As shown in FIG. 3, the stopper ring 80 is formed by causing a pair of C-shaped ring members 81 to be turnably coupled to each other via a pin 82, and the C-shaped ring members 81 form a ring by inserting a bolt 84 into holes 83 formed in tip ends of the C-shaped ring members 81.

As also shown in FIG. 4, the C-shaped ring members 81 have protruding portions 85 of circular arc-shapes, as viewed from a plane, which are provided on inner surfaces of the C-shaped ring members 81 and engaged with the ring-shaped groove 54 of the steering shaft 50 (loosely fitted in the ring-shaped groove 54 so as not to prevent the rotation of the steering shaft 50). Inserting of the bolt 84 into the holes 83 of the tip ends of the C-shaped rings 81 is performed while causing the protruding portions 85 to be fitted into the ring-shaped groove 54, whereby the C-shaped ring members form the form and are mounted around the steering shaft 50.

As shown in FIG. 3, the respective C-shaped ring members 81 are formed in middle portions thereof with insertion holes 87 for bolts 86.

Figure 6:
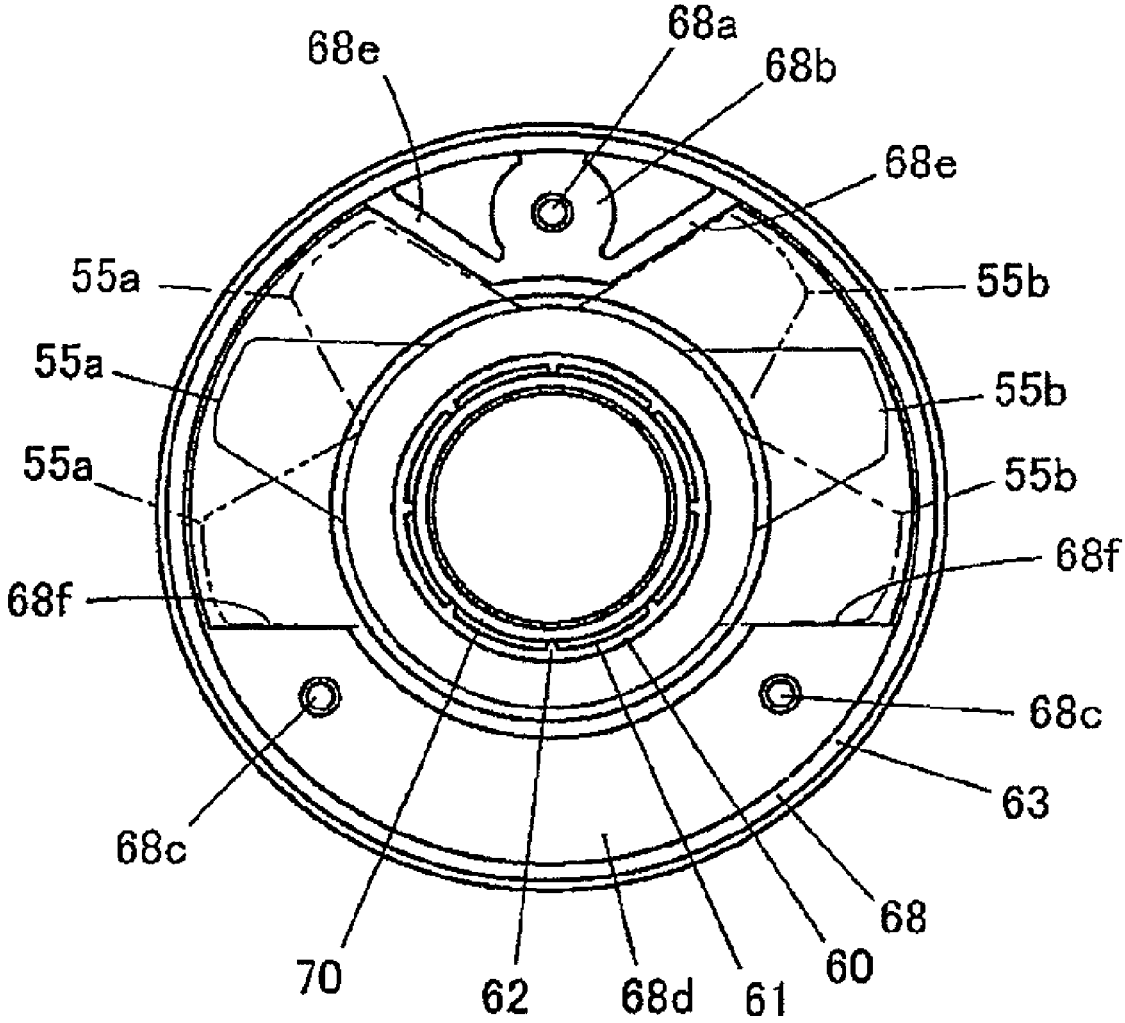
FIG. 6 is a partially abbreviated sectional-view, taken along VI-VI line in FIG. 4.

On the other hand, as shown in FIG. 6, an inner wall surface of a cylindrical portion 68 provided on an upper portion of the steering holder 63 is provided with a block-shaped stopper portion 68*b* formed with a tapped hole 68*a* for the bolt 84, and a block-shaped stopper portion 68*d* which is formed with tapped holes 68*c* for the bolts 86 and has a circular arc-shape as viewed from a plane.

Therefore, after the steering shaft 50 is inserted in the bearing section 60 in the condition where the stopper ring 80 is mounted around the steering shaft 50 in the manner as discussed above, the stopper ring 80 is fixed to the stopper portions 68*b*, 68*d* by causing the bolt 84 and the bolts 86 to be inserted into the tapped hole 68*a* and the tapped holes 68*c*, respectively, whereby the steering shaft 50 is mounted with respect to the bearing section 60 and the protruding portions 85 of the stopper ring 80 are engaged with the ring-shaped groove 54 of the steering shaft 50 so that an axial movement of the steering shaft 50 is restricted.

As shown in FIG. 6, the block-shaped stopper portion 68*b* is reinforced by rib 68*e* which are adapted to be able to be abutted on the pair of protruding portions 55*a*, 55*b* for restricting the rotation angle (rotation range) of the steering shaft 50.

Moreover, end regions 68*f* of the circular arc-shaped stopper portion 68*d* are also adapted to be able to be abutted on the pair of protruding portions 55*a*, 55*b* for restricting the rotation angle (rotation range) of the steering shaft 50.

Therefore, the steering shaft 50 can be rotated in a right direction within the range in which, from neutral positions indicated in FIG. 6 by solid lines (positions which allow the small watercraft 10 to go straight), the protruding portion 55*a* is abutted on one rib 68*e* and the protruding portion 55*b* is abutted on one end region 68*f* of the circular arc-shaped stopper portion 68*d*, as shown in chain lines (these abuttings basically occur simultaneously). Moreover, the steering shaft 50 can be rotated in a left direction within the range in which, from the neutral positions, the protruding portion 55*a* is abutted on the other end region 68*f* of the circular arc-shaped stopper portion 68*d* and the protruding portion 55*b* is abutted on the other rib 68*e*, as shown by chain double-dashed lines (also, these abuttings basically occur simultaneously).

As shown in FIG. 4, in this embodiment, the bearing section 60 also has a plurality of ribs 62' extending in the axial direction of the steering shaft 50 (extending in an upper/lower direction in FIG. 4) provided around a lower region of the inner surface 61 thereof, and a collar 70' formed from an elastic material is provided interposedly between the ribs 62' and the outer surface 51 of the steering shaft 50.

Regarding the rib 62', it is desirable that at least three or more ribs are provided and, in the illustrated embodiment, eight ribs 62 are provided so as to be disposed at equal pitches. Upper ends 62*a'* of the ribs 62' also exhibit upward ascending slopes. The material of the collar 70' is the same as the material of collar 70.

As shown in FIG. 4, the steering shaft 50 is also provided at a lower end region thereof with a lever mounting portion 56 to which a lever 57 shown in FIG. 3 is mounted.

A link 58 that forms a part of the association mechanism is coupled to a tip end of the lever 57 and coupled to the lever 33*a* of the nozzle 33 of the jet pump 30 (FIG. 2) through the association mechanism.

Therefore, when the steering handlebar 13 is turning-operated, the nozzle 33 is pivoted, to thereby change the course of the watercraft body 11.

According to the steering unit for the small watercraft, which is constructed as discussed above, the following operation and effect are obtained.

In the steering unit for the small watercraft, the cylindrical bearing section 60 is provided around the inner surface 61 thereof with the plurality of ribs 62 (and/or the ribs 62', hereinafter referred to in the same manner) extending in the axial direction of the steering shaft 50, and the steering shaft 50 is rotatably supported by the bearing section 60 with the collar 70 (and/or the collar 70', hereinafter referred to in the same manner), made from the elastic material, being provided interposedly between the ribs 62 and the outer surface 51 of the steering shaft 50, so that even if dimensional precisions of the steering shaft 50 and the bearing section 60 are not always high, jolting of the steering shaft relative to the bearing section can be prevented by the collar 70 formed from the elastic material.

Moreover, the cylindrical bearing section 60 is provided around the inner surface 61 thereof with the plurality of ribs 62 extending in the axial direction of the steering shaft 50, and the collar 70 made from the elastic material is provided interposedly between the ribs 62 and the outer surface 51 of the steering shaft 50, so that even if a thickness of the collar 70 formed from the elastic material is made rather thick in order to positively prevent the jolting of the steering shaft 50 relative to the bearing section 60. Thus, the steering shaft 50 does not become a condition in which the steering shaft 50 is pushed by a substantially entire inner surface of the collar 70, and becomes a condition in which the steering shaft 50 is pushed at only regions thereof which positionally correspond to the ribs 62.

Figure 7:
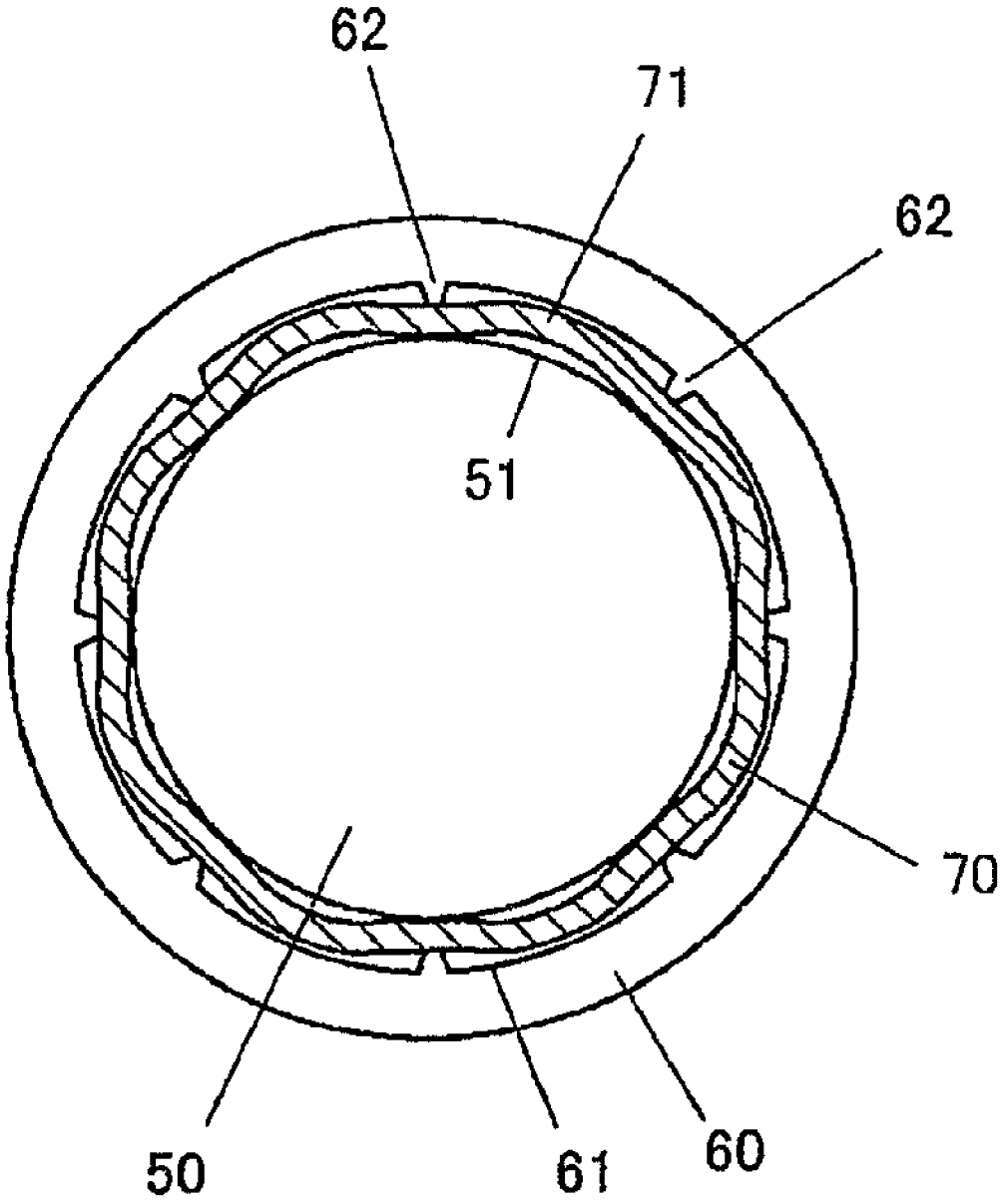
FIG. 7 is an explanatory view of operation (a view corresponding to a sectional view taken along VII-VII line in FIG. 5).

This condition of the steering shaft 50 is schematically shown in FIG. 7.

As shown in FIG. 7, even if the thickness of the collar 70 is made rather thick, the steering shaft 50 does not become the condition in which the steering shaft 50 is pushed by the substantially entire inner surface of the collar 70, and becomes the condition in which the steering shaft 50 is pushed at the only regions thereof which positionally correspond to the ribs 62. In other words, regions 71 of the collar 70 which are located between respective adjacent ribs 62 become a condition in which, exaggeratedly speaking, they are escaped outward in a radial direction of the steering shaft 50, and become a condition in which they do not push the steering shaft 50.

Therefore, even if the thickness of the collar 70 formed from the elastic material is made rather thick in order to positively prevent the jolting of the steering shaft 50 relative to the bearing section, smooth rotation of the steering shaft 50 is allowed.

Moreover, the regions 71 of the collar 70 which are located between the respective adjacent ribs 62 can be escaped outward in the radial direction of the steering shaft 50, thus making it possible to smoothly perform the inserting operation of the steering shaft 50 and the collar 70 into the bearing section 60.

As discussed above, according to this embodiment, the jolting of the steering shaft 50 relative to the bearing section 60 can be positively prevented and, at the same time, the rotation of the steering shaft 50 is allowed to be smoothly performed. In addition, installing characteristic of the steering shaft 50 and the collar into the bearing section 60 can be improved.

Moreover, the upper ends 62*a* of the ribs 62 exhibit the upward ascending slopes (ascending toward an upstream side of such a direction that the steering shaft 50 is inserted), so that the installing characteristic of the steering shaft 50 and the collar into the bearing section 60 can be further improved.

In addition, the at least three or more ribs 62 (in this embodiment, the eight ribs) are provided, thus making it possible to cause the steering shaft 50 to be supported in a stable state by the bearing section 60.

While the present invention is discussed above with reference to the embodiment of the present invention, the present invention is not limited to the embodiment, and modifications and variations can be suitably made to the embodiment within the scope of the spirit of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A steering unit for a small watercraft, comprising:

a cylindrical bearing section; and a steering shaft inserted in the cylindrical bearing section and rotatably supported to a watercraft body by the cylindrical bearing section;

wherein the cylindrical bearing section includes a plurality of ribs provided around an inner surface thereof and extending in an axial direction of the steering shaft, and the steering shaft is rotatably supported by the cylindrical bearing section with a collar, formed from an elastic material, being provided interposedly between the ribs and an outer surface of the steering shaft, wherein the steering shaft includes an enlarged diameter portion and the ribs are positioned on the cylindrical bearing section to correspond with the enlarged diameter portion of the steering shaft, and wherein the collar is interposed between the ribs and the enlarged diameter portion with upper ends of the ribs being formed with upwardly ascending slopes.

2. The steering unit for the small watercraft according to claim 1, wherein the cylindrical bearing section includes at least three or more ribs are provided.

3. The steering unit for the small watercraft according to claim 1, wherein the cylindrical bearing section includes eight ribs disposed at equal pitches are provided.

4. The steering unit for the small watercraft according to claim 1, wherein the collar is formed of at least one of rubber and synthetic resin.

5. The steering unit for the small watercraft according to claim 1, and further including a steering holder and a having a support section operatively positioned relative to the cylindrical bearing section for supporting the steering unit relative to the small watercraft.

6. The steering unit for the small watercraft according to claim 5, wherein the support section includes a cylindrical portion with reinforcing ribs interconnecting the cylindrical portion and the cylindrical bearing section.

7. The steering unit for the small watercraft according to claim 6, wherein eight reinforcing ribs are disposed at substantially equal intervals around a circumference of the support section.

8. A steering unit for the small watercraft, comprising:

a steering holder having a cylindrical bearing section;

a steering shaft inserted in the cylindrical bearing section and rotatably supported to a watercraft body by the cylindrical bearing section;

wherein the cylindrical bearing section includes a plurality of ribs provided around an inner surface thereof and extending in an axial direction of the steering shaft, and the steering shaft is rotatably supported by the cylindrical bearing section with a collar, formed from an elastic material, being provided interposedly between the ribs and an outer surface of the steering shaft, wherein an upper part of the steering holder includes a cylindrical portion having a pair of stopper portions extending inwardly on opposite sides thereof, and further including:

a stopper ring fixed to the pair of stopper portions, the stopper ring having a pair of protruding portions which engage with a ring-shaped groove in the steering shaft for restricting axial movement of the steering shaft, wherein a portion of the steering shaft surrounded by the cylindrical portion of the steering holder is provided with a pair of protruding projections projecting outwardly from opposite sides thereof in positions between the stopper portions of the steering holder, wherein rotation of the steering shaft is restricted when each of the protruding projections abuts, respectively, against a corresponding one the stopper portions.

9. A steering unit for a vehicle comprising:

a cylindrical bearing section;

a steering shaft inserted in the cylindrical bearing section and rotatably supported by the vehicle body by the cylindrical bearing section;

a plurality of ribs formed in the cylindrical bearing section, said plurality of ribs being provided around an inner surface thereof and extending in an axial direction of the steering shaft; and a collar operatively positioned relative to the cylindrical bearing section for rotataby supporting the steering shaft, said collar being formed from an elastic material and being provided interposedly between the ribs and an outer surface of the steering shaft, wherein the steering shaft includes an enlarged diameter portion and the ribs are positioned on the cylindrical bearing section to correspond with the enlarged diameter portion of the steering shaft, and wherein the collar is interposed between the ribs and the enlarged diameter portion with upper ends of the ribs being formed with upwardly ascending slopes.

10. The steering unit for the vehicle according to claim 9, wherein the cylindrical bearing section includes at least three or more ribs are provided.

11. The steering unit for the vehicle according to claim 9, wherein the cylindrical bearing section includes eight ribs disposed at equal pitches are provided.

12. The steering unit for the vehicle according to claim 9, wherein the collar is formed of at least one of rubber and synthetic resin.

13. The steering unit for the vehicle according to claim 9, and further including a steering holder having a support section operatively positioned relative to the cylindrical bearing section for supporting the steering unit relative to the vehicle.

14. The steering unit for the vehicle according to claim 13, wherein the support section includes a cylindrical portion with reinforcing ribs interconnecting the cylindrical portion and the cylindrical bearing section.

15. The steering unit for the vehicle according to claim 14, wherein eight reinforcing ribs are disposed at substantially equal intervals around a circumference of the support section.

16. The steering unit for the vehicle according to claim 8, wherein the steering shaft includes an enlarged diameter portion and the ribs are positioned on the cylindrical bearing section to correspond with the enlarged diameter portion of the steering shaft.

17. The steering unit for the vehicle according to claim 9, wherein the collar is interposed between the ribs and the enlarged diameter portion with upper ends of the ribs being formed with upwardly ascending slopes.

18. The steering unit for the vehicle according to claim 9, and further including a stopper ring mounted within a ring-shaped groove in the steering shaft for restricting axial movement of the steering shaft.

* * * * *